US008678874B2

(12) United States Patent
Gary et al.

(10) Patent No.: US 8,678,874 B2
(45) Date of Patent: Mar. 25, 2014

(54) COLLECTIBLE MINIATURE FIGURINE WITH DETACHABLE GAME BASE

(75) Inventors: Justin Gary, Dana Point, CA (US); Bill Atkinson, Fallbrook, CA (US)

(73) Assignee: The Upper Deck Company, Carlsbad, CA (US)

( * ) Notice: Subject to any disclaimer, the term of this patent is extended or adjusted under 35 U.S.C. 154(b) by 692 days.

(21) Appl. No.: 12/366,570

(22) Filed: Feb. 5, 2009
(Under 37 CFR 1.47)

(65) Prior Publication Data

US 2009/0286450 A1 Nov. 19, 2009

Related U.S. Application Data

(60) Provisional application No. 61/063,927, filed on Feb. 6, 2008.

(51) Int. Cl.
*A63H 1/00* (2006.01)
*A63F 3/00* (2006.01)

(52) U.S. Cl.
USPC ..... 446/236; 273/288; 273/289

(58) Field of Classification Search
USPC ..... 446/71–73, 236, 268; 273/236, 288, 273/139, 143 R, 148 R, 289
See application file for complete search history.

(56) References Cited

U.S. PATENT DOCUMENTS

| | | | | | |
|---|---|---|---|---|---|
| 2,210,201 | A * | 8/1940 | Draper et al. | ..... | 273/141 R |
| 3,945,644 | A * | 3/1976 | Ortiz | ..... | 273/143 D |
| 4,186,516 | A * | 2/1980 | Ensmann | ..... | 446/238 |
| 5,217,225 | A * | 6/1993 | Dubarry, Jr. | ..... | 273/141 R |
| 6,217,022 | B1 * | 4/2001 | Astaneha | ..... | 273/138.1 |
| 6,899,332 | B2 * | 5/2005 | Weisman | ..... | 273/289 |
| 6,899,333 | B2 * | 5/2005 | Weisman | ..... | 273/289 |
| 6,918,590 | B2 * | 7/2005 | Annis et al. | ..... | 273/289 |
| 7,290,767 | B2 * | 11/2007 | Wilk et al. | ..... | 273/288 |
| 7,731,194 | B2 * | 6/2010 | Ishihara et al. | ..... | 273/288 |
| 2004/0051245 | A1 * | 3/2004 | Weisman et al. | ..... | 273/262 |
| 2005/0023749 | A1 * | 2/2005 | Annis et al. | ..... | 273/138.1 |
| 2007/0018397 | A1 * | 1/2007 | Ishihara et al. | ..... | 273/288 |
| 2008/0048396 | A1 * | 2/2008 | Andersen | ..... | 273/288 |

* cited by examiner

*Primary Examiner* — Gene Kim
*Assistant Examiner* — Alyssa Hylinski
(74) *Attorney, Agent, or Firm* — Roeder & Broder LLP

(57) ABSTRACT

A combination for use as a collectible item or a game piece includes a collectible miniature figurine and a first game assembly. The collectible miniature figurine includes a figure body and a figure base that retains and supports the figure body. The first game assembly includes a first game base that is selectively attachable to and detachable from the figure base without deforming either of the bases. Further, the figure base is selectively rotatable relative to the first game base when the figure base is attached to the first game base. Still further, the figure base can be selectively rotatable relative to the first game base in a step-like fashion.

30 Claims, 14 Drawing Sheets

COLLECTIBLE MINIATURE FIGURINE WITH DETACHABLE GAME BASE

RELATED APPLICATION

This Application claims the benefit on U.S. Provisional Application Ser. No. 61/063,927, filed on Feb. 6, 2008. The contents of U.S. Provisional Application Ser. No. 61/063,927 are incorporated herein by reference.

BACKGROUND

A collectible miniature figurine is a figure that is collected, or that is designed or suitable to be collected, for purposes of hobby, gaming, display or investment.

Typically, the better condition a collectible miniature figurine is in the more valuable it may be. Further, collectible miniature figurines that are less adorned with extraneous features that are not necessary to the collectible miniature figurine itself, e.g., markings, letterings, or other physical additions to a base which supports the collectible miniature figurine, may also make a collectible miniature figurine more valuable.

It is also common today that collectible miniature figurines may be used as part of a game piece to be used with a particular game. In such situations, the collectible miniature figurine is typically rotatably and fixedly secured to a game base.

SUMMARY

The present invention is directed to a combination comprising a collectible miniature figurine and a first game assembly. The collectible miniature figurine includes a figure body and a figure base that retains and supports the figure body. In certain embodiments, the first game assembly includes a first game base that is selectively attachable to and detachable from the figure base without deforming either of the bases. For example, the first game base that is selectively attachable to and detachable from the figure base without permanently changing the shape of either of the bases. Further, the figure base is selectively rotatable relative to the first game base when the figure base is attached to the first game base. Still further, the figure base can be selectively rotatable relative to the first game base in a step-like fashion.

With this design, in certain embodiments, the collectible miniature figurine can be easily detached from the game assembly to provide an information free collectible miniature figurine for display, and can be easily attached to the game assembly so that the combination can be used to track data during playing of the game. Thus, the combination can be easily used in the game and subsequently, the collectible miniature figurine can be displayed as a collection piece.

In one embodiment, the first game base includes a ring shaped channel and the figure base includes a substantially disk shaped mounting section and a ring shaped cantilever section that extends downward away from the mounting section. Further, the cantilever section is sized and shaped to fit within the channel of the first game base.

In certain embodiments, the first game assembly includes a first game insert that is secured to and moves with the first game base. Further, the first game insert includes first game information that is used in a game. Still further, the figure base includes a slot that selectively reveals a portion of the first game information.

In some embodiments, the first game base is attached to and is supported by a first base support. Additionally, the first game base can selectively rotate relative to the first base support when the first game base is attached to the first base support. Further, the first base support includes first supplemental game information that is used in the game. Still further, the first game base includes one or more openings that selectively reveal a portion of the first supplemental game information.

Additionally, in certain embodiments, the combination further comprises a second game assembly that includes a second game base that is selectively attachable to and detachable from the figure base without deforming either the second game base or the figure base. Further, the second game assembly can include a second game insert that is secured to and moves with the second game base. Still further, the second game insert includes second game information that is used in a game, the second game information being different than the first game information.

Moreover, in certain embodiments, the first game base is selectively attachable to and detachable from the figure base without changing the shape of either of the bases during the entire attaching or detaching process. Thus, in certain embodiments, no piece of either base is bent during the entire attaching or detaching process.

Further, the present invention is also directed to a method for making a combination, the method comprising the steps of providing a collectible miniature figurine and providing a first game assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
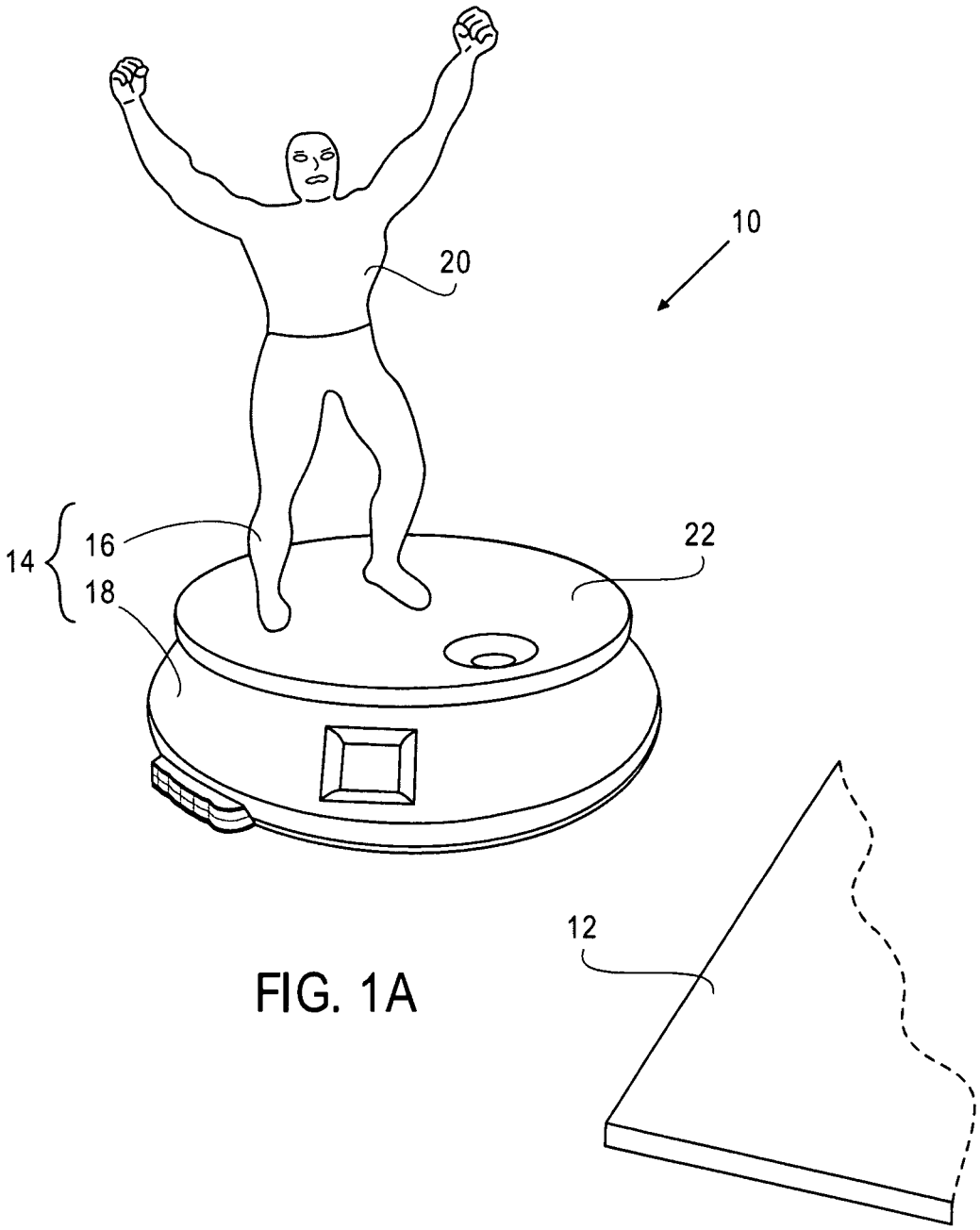
FIG. 1A is a perspective view of a game that includes a game board and a first embodiment of a combination having features of the present invention.

FIG. 1A is a perspective view of a game 10 that includes a game board 12 (only a portion is illustrated) and a first embodiment of a combination 14 having features of the present invention including a collectible miniature figurine 16 and a game assembly 18. The design of each of these components can be varied pursuant to the teachings provided herein.

As an overview, in certain embodiments, the combination 14 is uniquely designed so that the collectible miniature figurine 16 can be easily detached from the game assembly 18 to provide an information free collectible miniature figurine 16 for display, and can be easily attached to the game assembly 18 so that the combination 14 can be used to track data during playing of the game 10. Thus, the combination 14 can be easily used in the game 10 and subsequently, the collectible miniature figurine 16 can be displayed as a collection piece.

The design of the game board 12 will depend upon the type of game 10 that is being played. For example, the game board 12 can include a plurality of game positions (not shown) e.g. squares on the game board 12. Further, the game board can include certain illustrations on some positions to illustrate customizable terrain or features for game play.

As shown in FIG. 1A, the collectible miniature figurine 16 can include a figure body 20 and a figure base 22. The figure body 20 can be the figure of an action figure, a cartoon character, a sports figure, an animal, or any other figure that may be suitable for collecting or for use in the game 10.

The figure base 22 retains and supports the figure body 20. For example, the figure body 20 and the figure base 22 can be made as a one piece, unitary, homogeneous structure. Alternatively, the figure body 20 and the figure base 22 can be separate components that are fixedly or removably secured together.

Figure 1B:
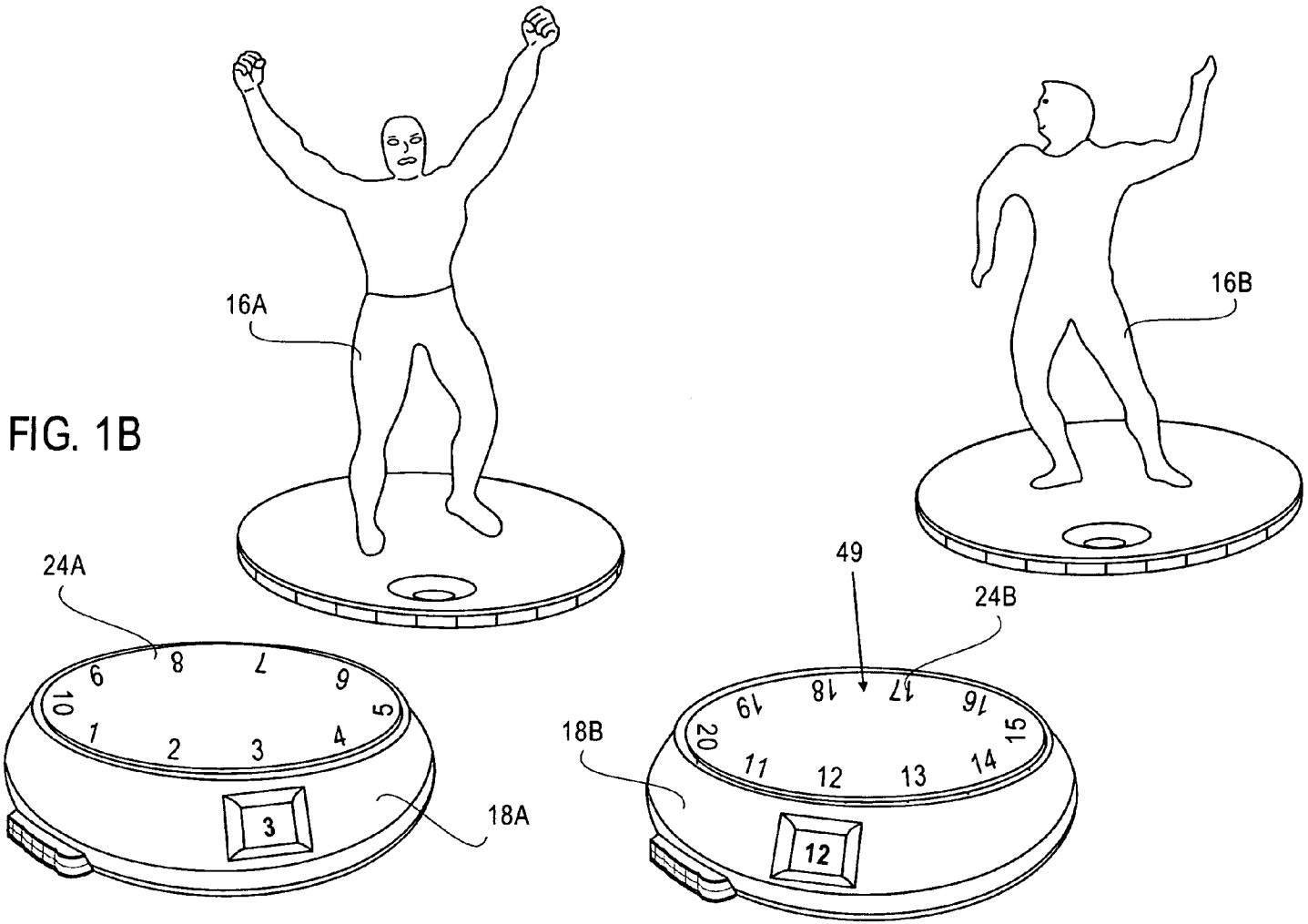
FIG. 1B is a perspective view of a collectible miniature figurine, a first game assembly, and a second game assembly having features of the present invention.

FIG. 1B is a perspective view of a first collectible miniature figurine 16A, a second collectible miniature figurine 16B, a first game assembly 18A, and a second game assembly 18B having features of the present invention. Either the first game assembly 18A or the second game assembly 18B can function as the game assembly 16 as illustrated in FIG. 1A and in other Figures described herein.

In this embodiment, either collectible miniature figurine 16A, 16B can be selectively attachable to and detachable from either of the game assemblies 18A, 18B. Stated another way, the first collectible miniature figurine 16A can be selectively, alternatively attached to either the first game assembly 18A or the second game assembly 18B. However, the first collectible miniature figurine 16A can not be attached to the first game assembly 18A and the second game assembly 18B at the same time. Similarly, the second collectible miniature figurine 16B can be selectively, alternatively attached to either the first game assembly 18A or the second game assembly 18B.

As illustrated in FIG. 1B, the collectible miniature figurines 16A, 16B are selectively detachable from both the first game assembly 18A and the second game assembly 18B. In this condition, the collectible miniature figurines 16A, 16B can easily be displayed as a collection pieces.

The first game assembly 18A can include first game information 24A that is used in the game. As shown in FIG. 1B, the first game information 24A can include a series of numbers. For example, the first game information 24A can include a series of numbers from 1 to 10. Alternatively, the first game information 24A can include another series of numbers, a series of letters, a series of symbols, or some other information pertinent to the game 10 being played.

Similarly, the second game assembly 18B can include second game information 24B that is used in the game. As shown in FIG. 1B, the second game information 24B can include a series of numbers. For example, the second game information 24B can include a series of numbers from 11 to 20. Alternatively, the second game information 24B can include another series of numbers, a series of letters, a series of symbols, or some other information pertinent to the game 10 being played.

In alternative embodiments, the second game assembly 18B can be useful in the same game as the first game assembly 18A, or the second game assembly 18B can be useful in a different game than the first game assembly 18A. Further, the same collectible miniature figurine 16 can be used with the different game info 24A, 24B.

Alternatively, the game assemblies 18A, 18B can include somewhat similar information. In this embodiment, the colors, shapes, or other artistic features of the game assemblies 18A, 18B can be different. This design feature allows the game assemblies 18A, 18B to be sold as collectibles separate from the collectible miniature figurines 16A, 16B.

Figure 1C:
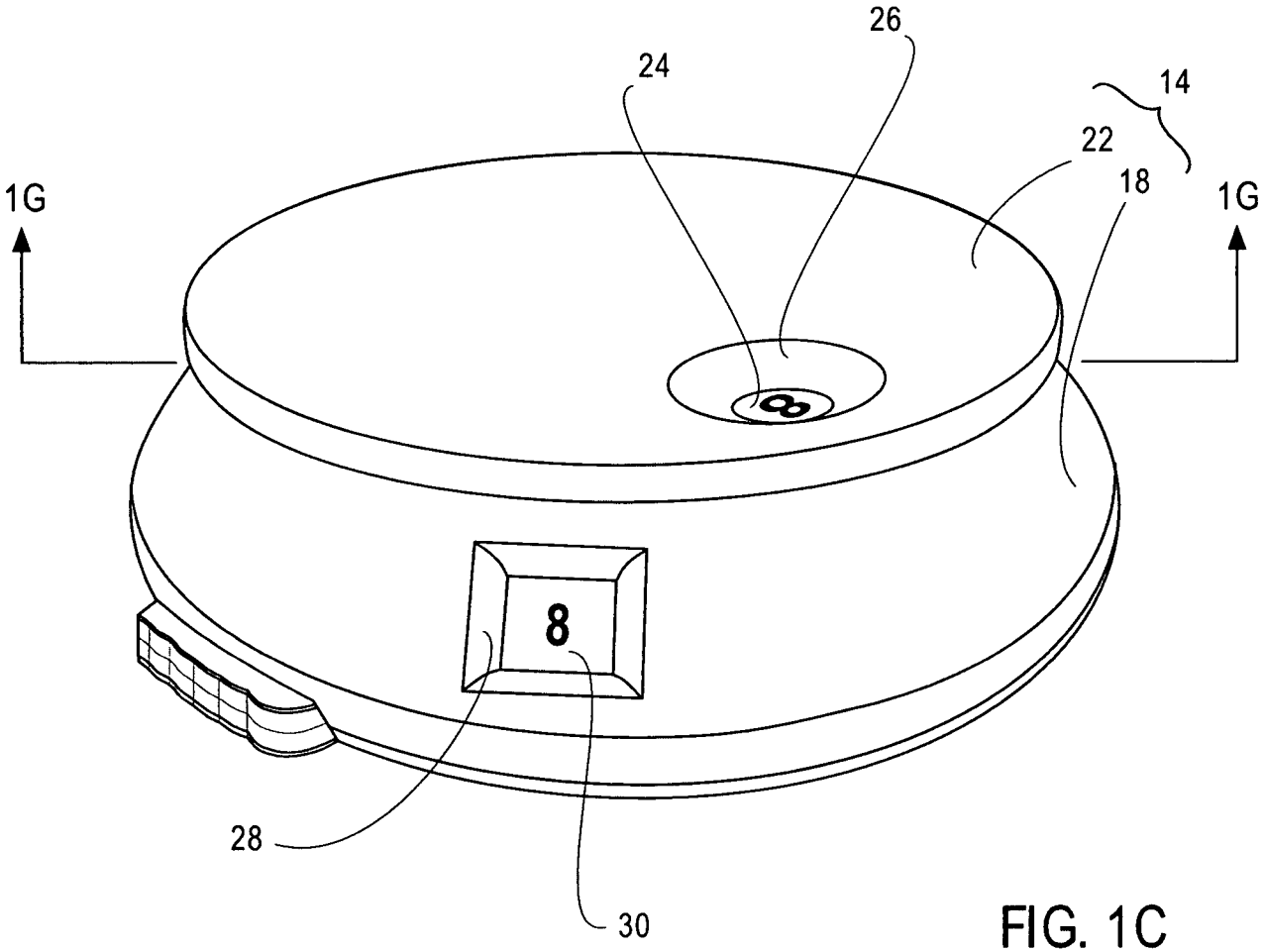
FIG. 1C is a perspective view of a portion of the combination of FIG. 1A.
Figure 1D:
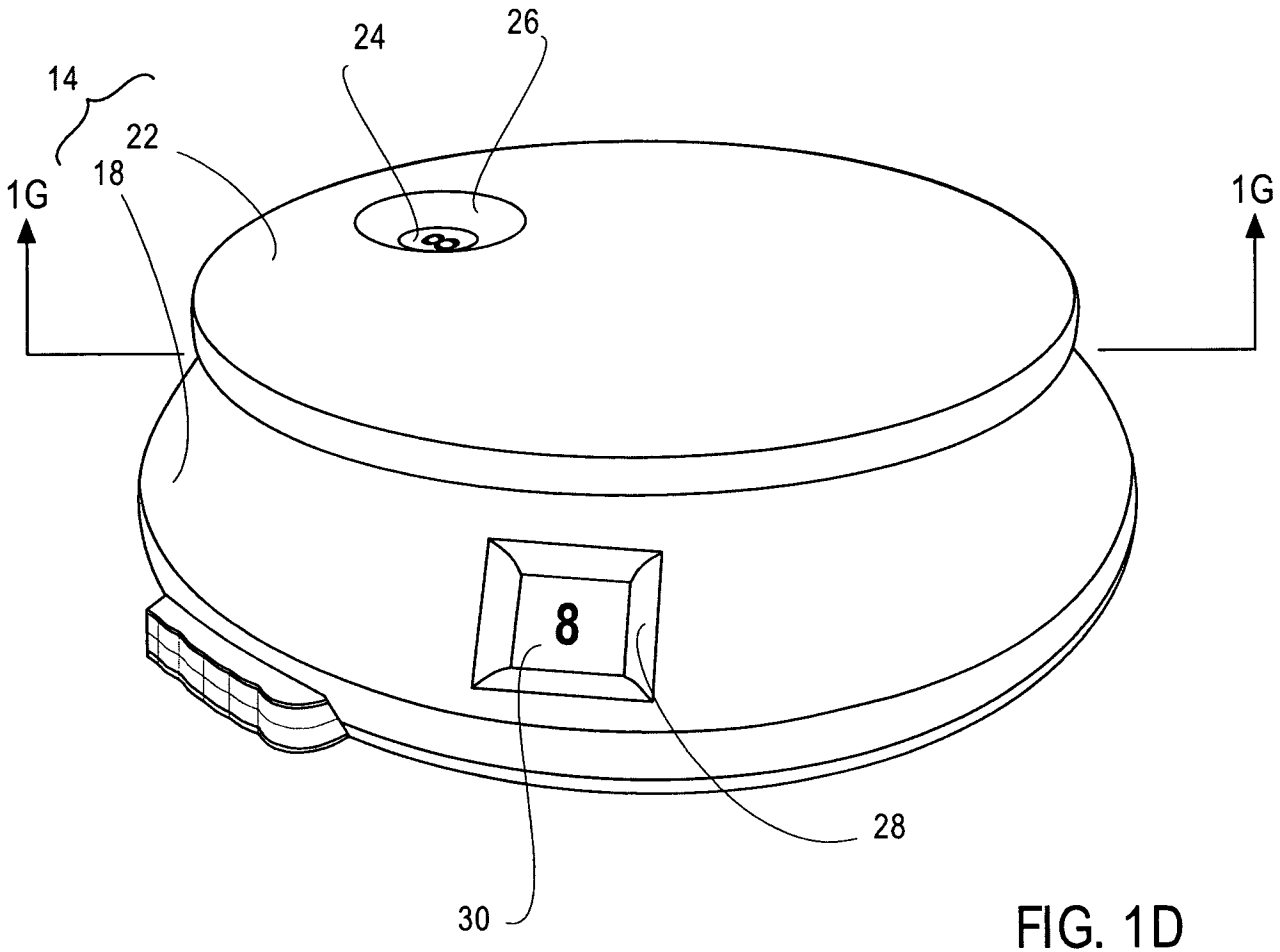
FIG. 1D is another perspective view of the combination of FIG. 1A.

FIG. 1C is a front perspective view and FIG. 1D is a rear perspective view of a portion of the combination 14 of FIG. 1A. FIG. 1C illustrates the figure base 22 and the game assembly 18 with the figure base 22 attached to the game assembly 18. The figure base 22 is selectively rotatable relative to the game assembly 16 when the figure base 22 is attached to the game assembly 16.

As shown in FIGS. 1C and 1D, the figure base 22 includes a slot 26 that selectively reveals a portion of game information 24. As noted above, the game information 24 can include a series of numbers, a series of letters, a series of symbols, or some other information pertinent to the game 10 being played. For example, this game information 24 can keep track of a power level, remaining life, or turn of the game piece.

In certain embodiments, the combination 14 is specifically designed so that the figure base 22 rotates relative to the game assembly 18 in a step-like fashion so that only one number, one letter, one symbol, or one other information of the game information 24 is revealed at the end of each step of the step-like rotation.

Additionally, the game assembly 16 can include one or more openings 28 that selectively reveal a portion of supplemental or additional game information 30. The supplemental game information 30 can include a series of numbers, a series of letters, a series of symbols, or some other information pertinent to the game 10 being played. For example, this supplemental game information 30 can keep track of a power level, remaining life, or turn of the game piece. In the embodiment illustrated in FIGS. 1C and 1D, for example, the game assembly 16 includes two spaced apart openings 28 (one on each side of the game assembly 16). Further, the same information can be revealed in each opening 28. For example, in FIGS. 1C and 1D, the number "8" is visible in each opening 28. With this design, players on opposite sides of the game board and game assembly 16 can easily view the information revealed by the openings 28.

The game assembly 16 is specifically designed so that in a step-like fashion only one number, one letter, one symbol, or one other information of the supplemental game information 30 is typically revealed through each of the one or more openings 28 at the end of each step.

Figure 1E:
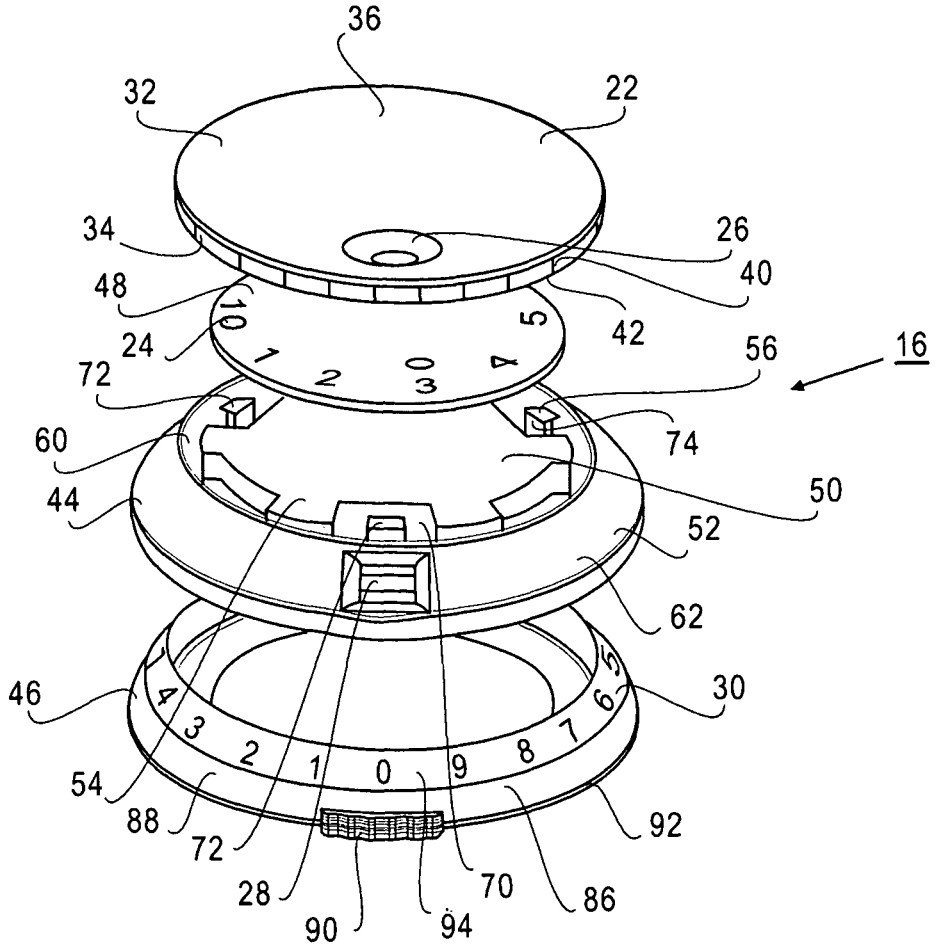
FIG. 1E is a top, exploded perspective view of the portion of the combination of FIGS. 1C and 1D.
Figure 1F:
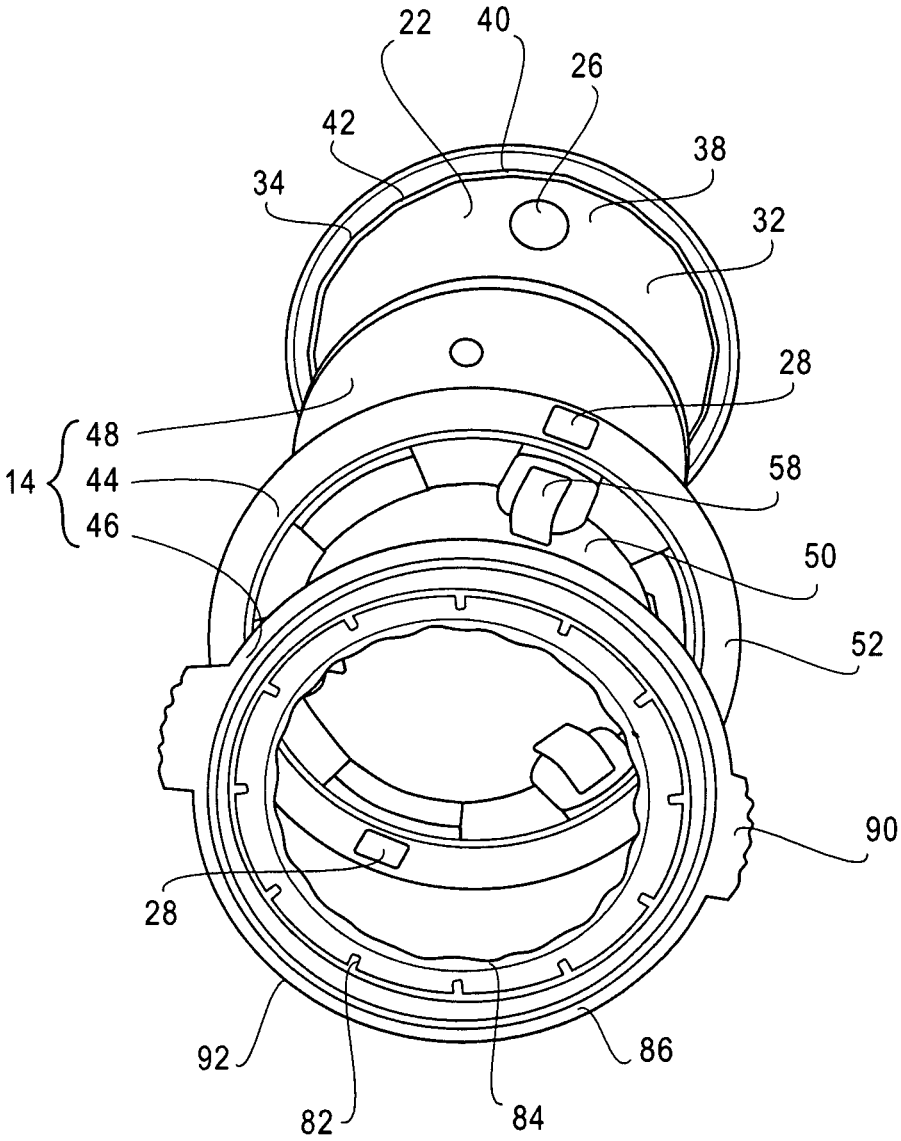
FIG. 1F is a bottom, exploded perspective view of the portion of the combination of FIGS. 1C and 1D.
Figure 1G:
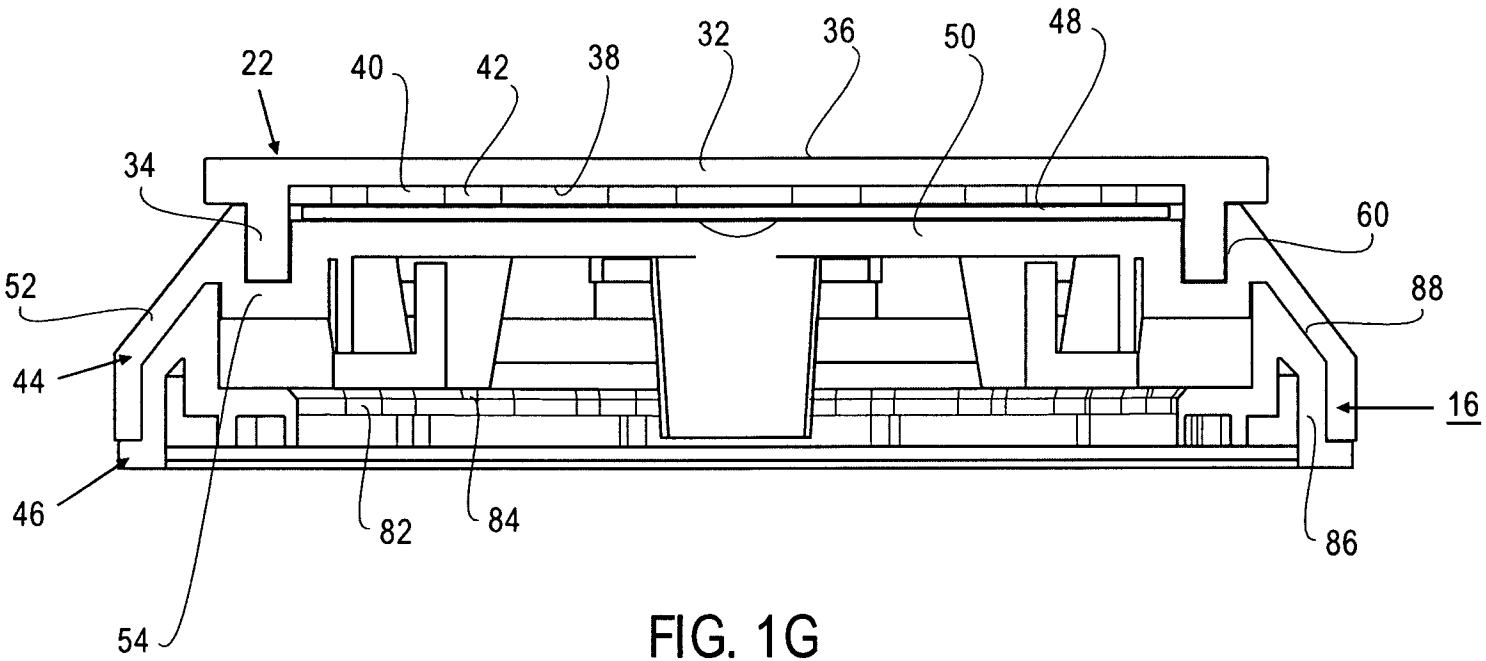
FIG. 1G is a cut-away view on line 1G-1G in FIG. 1C.
Figure 1H:
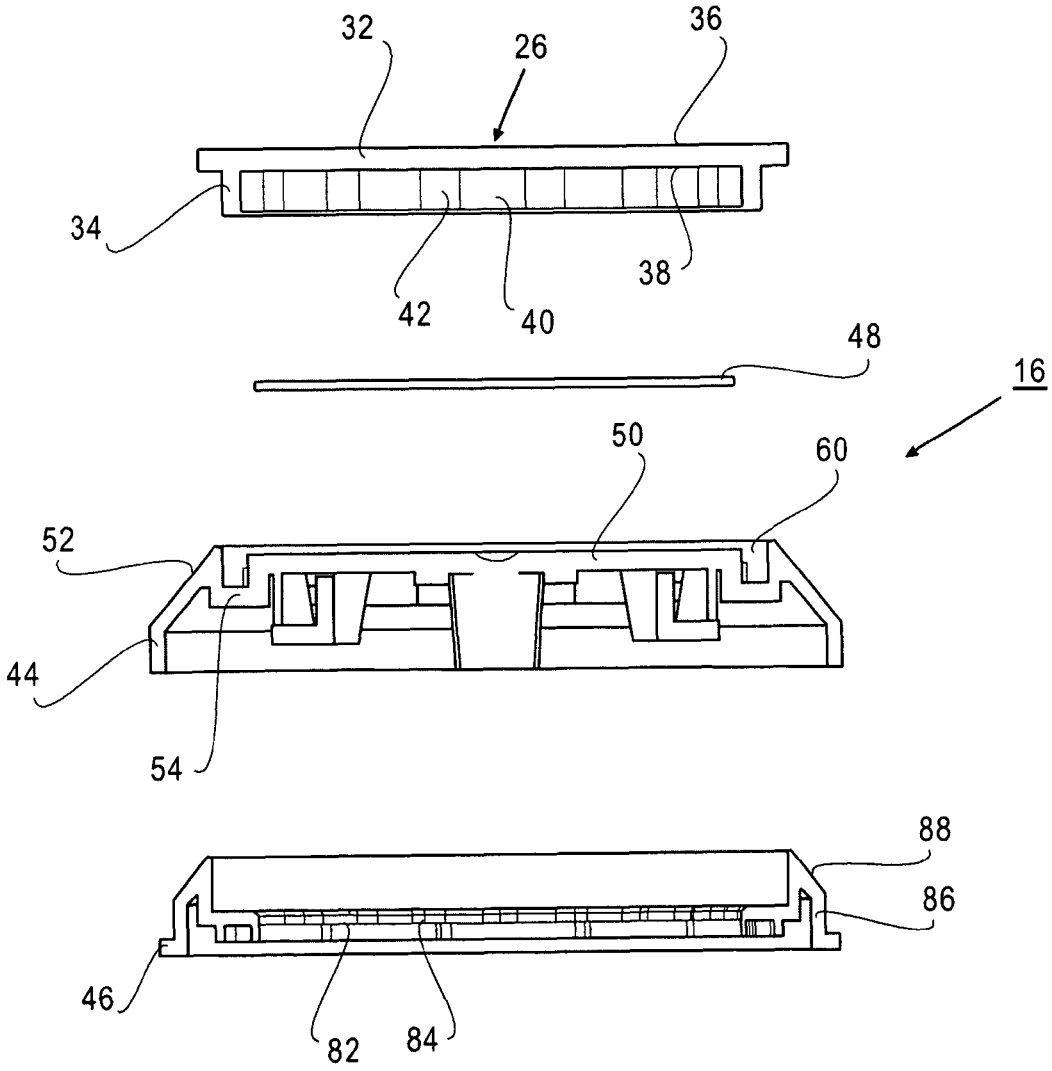
FIG. 1H is an exploded cut-away view from FIG. 1G.

FIG. 1E is a top, exploded perspective view of the portion of the combination of FIG. 1C; FIG. 1F is a bottom, exploded perspective view of the portion of the combination of FIG. 1C; FIG. 1G is a cut-away view on line 1G-1G in FIG. 1C; and FIG. 1H is an exploded cut-away view from FIG. 1G. More precisely, FIGS. 1E-1H illustrate varying views of the figure base 22 and the game assembly 16 having features of the present invention.

As illustrated in FIGS. 1D-1H, the figure base 22 includes a substantially planar mounting section 32 and a substantially ring shaped cantilever section 34 that extends downward away from the mounting section 32. The mounting section 32 has a top surface 36, a bottom surface 38, and the slot 26. As shown in the Figures, the mounting section 32 is substantially circular disk shaped. Alternatively, the mounting section 32 can be designed to be of a different shape. For example, the mounting section 32 can be octagon shaped, hexagon shaped, square shaped, triangle shaped, oval shaped, or some other shape.

The top surface 36 is a substantially flat and circular surface that supports the figure body 20. In one embodiment, the figure body 20 can be mounted on and fixedly secured to the top surface 36 of the mounting section 32. Alternatively, the figure body 20 can be detachably secured to the top surface 36 of the mounting section 32, so that the figure body 20 may be removed from the top surface 36 and a different figure body 20 may be secured to the top surface 36 of the mounting section 32. Still alternatively, the figure body 20 and the figure base 22 can be made as a one piece, unitary, homogeneous structure.

In certain embodiments the top surface 36 of the mounting section 32 of the figure base 22 can be designed to be free of any physical markings or physical adornments of any kind, so as to be suitable for display purposes. For example, the top surface 36 of the mounting section 32 of the figure base 22 can be designed to be free of all game information 24, when the collectible miniature figurine 16 is used in combination with the game assembly 18 as a game piece for the game 10. Alternatively, top surface 36 of the mounting section 32 of the figure base 22 could include a plurality of surface features. For example, the surface features could be a plurality of spaced apart substantially rectangular shaped sections, a plurality of square shaped sections, a plurality of triangle shaped sections, a plurality of circular bumps, a plurality of star shaped bumps, a plurality of circular indentations, a plurality of rectangular shaped indentations, or some other types of surface features.

The cantilever section 34 extends downward away from the bottom surface 38 of the mounting section 32, and the cantilever section 34 is sized and shaped to fit within a portion of the game assembly 18. Additionally, the cantilever section 34 is designed so that the collectible miniature figurine 16 can be selectively rotated relative to at least a portion of the game assembly 18. For example, the cantilever section 34 can include a plurality of short segments 40 and a plurality of bumps 42 positioned between adjacent short segments 40, which cooperate with a portion of the game assembly 18 to enable the collectible miniature figurine 16 to rotate relative to at least a portion of the game assembly 18 in a step-like fashion.

The slot 26 extends through the mounting section 32 and is designed to reveal game statistics or more game information independent or dependent on the information revealed in slot 28. As shown in the Figures, the slot 26 is substantially circular. Alternatively, the slot 26 can be a different shape. For example, the slot 26 can be square shaped, triangle shaped, pentagon shaped, or some other shape.

As shown in FIGS. 1E-1H, the game assembly 18 can include (i) a game base 44; (ii) a base support 46 that selectively retains the game base 44 and supports the game base 44; and (iii) a first game insert 48 that is mounted on the game base 44, the first game insert 48 including game information 24 that is used in the game 10. Alternatively, for example, the first game insert 48 and the game base 44 can be made as a single piece.

The game base 44 is designed to be selectively attachable to and detachable from the figure base 22 without deforming or otherwise manipulating the game base 44 or the figure base 22. The figure base 22 and the collectible miniature figurine 16 are designed to rotate relative to the game base 44. In some embodiments, the figure base 22 and the collectible miniature figurine 16 are designed to rotate relative to the game base 44 in a step-like fashion.

The game base 44 can include (i) a substantially circular middle portion 50; (ii) a substantially ring shaped outer portion 52; (iii) a plurality of spaced apart connectors 54 that connect the middle portion 50 and the outer portion 52; (iv) a plurality of spaced apart tabs 56; (iv) a plurality of spaced apart attachers 58; and (vi) a substantially ring shaped channel 60 that is positioned substantially between the middle portion 50 and the outer portion 52, the channel 60 being sized and shaped to selectively receive the cantilever section 34 of the figure base 22.

The middle portion 50 is substantially circular and planar in shape and is designed to provide a surface that the first game insert 48 may be mounted upon. As the collectible miniature figurine 16 is rotated relative to the game base 44, a portion of the game information 24 is selectively revealed through the slot 26 that extends through the mounting section 32 of the figure base 22.

The outer portion 52 is substantially ring shaped and includes an angled outer surface 62 that includes the one or more openings 28. Each of the one or more openings 28 is designed to selectively reveal a portion of the base support 46 when the game base 44 is mounted on the base support 46. The outer portion 52 includes two openings 28 for selectively revealing two distinct portions of the base support 46. Alternatively, the outer portion 52 can have more than two openings 28 or less than two openings 28 for selectively revealing portions of the base support 46.

The middle portion 50 is connected to the outer portion 52 via the plurality of spaced apart connectors 54. In one embodiment, the connectors 54 are somewhat Z-shaped and include a substantially wedge-shaped connector inner section that extends radially outward away from the middle portion 50, a substantially wedge-shaped connector outer section that extends radially inward from the outer portion 52, and a connector middle section that extends perpendicularly between the connector inner section and the connector outer section. The specific design of the connector middle section provides essentially a downward step between the connector inner section and the connector outer section, which helps to define the channel 60 that is positioned between the middle portion 50 and the outer portion 52 of the game base 44. One connector 54 is positioned on either side of each of the plurality of spaced apart tabs 56. As shown in the Figures, the game base 44 can include six connectors 54. Alternatively, the game base 44 can be designed with more than six connectors 54 or less than six connectors 54.

The plurality of spaced apart tabs 56 are designed to allow the figure base 22 to rotate relative to the game base 44 in a step-like fashion. As illustrated in FIGS. 1E-1H, the tabs 56 are substantially U-shaped and they extend downward toward the base support 46 from the perimeter of the middle portion 50. In this embodiment, each of the tabs 56 is positioned between a pair of spaced apart connectors 54, so that the tabs 56 are spaced apart equidistantly around the perimeter of the middle portion 50 of the game base 44.

Each of the plurality of tabs 56 includes a tab inner portion 70 and a tab outer portion 72. The tab inner portion 70 is connected directly to the middle portion 50 of the game base 44, and the tab outer portion 72 is positioned so that it cantilevers and extends slightly into the channel 60 that is positioned between the middle portion 50 and the outer portion 52 of the game base 44 when the tab outer portion 72 is in an undeflected position 74. The tab outer portion 72 is designed to deflect slightly between the undeflected position 74 and a deflected position (not shown) as the figure base 22 rotates relative to the game base 44 when the cantilever section 34 of the figure base 22 is positioned within the channel 60 of the game base 44. The tab outer portion 72 of each tab 56 deflects slightly inwardly to the deflected position as it is contacted by one of the plurality of short segments 40 as the figure base 22 rotates relative to the game base 44. As the figure base 22 continues to rotate relative to the game base 44, the tab outer portion 72 of each tab 56 moves to the undeflected position 74 as it moves within one of the plurality of bumps 42 on the cantilever section 34. The movement of the plurality of tabs 56 between the deflected position and the undeflected position 74 allows the figure base 22 to rotate relative to the game base 44 in a step-like fashion. As shown in FIGS. 1E and 1F, the game base 44 can include three tabs 56. Alternatively, the game base 44 can be designed with more than three tabs 56 or less than three tabs 56.

The plurality of spaced apart attachers 58 are designed to maintain the game base 44 selectively attached to the base support 46. In one embodiment, the attachers 58 can be substantially L-shaped and they extend downward toward the base support 46 from the perimeter of the middle portion 50 of the game base 44. Each of the attachers 58 is positioned between a pair of spaced apart tabs 56, so that the attachers 58 are spaced apart equidistantly around the perimeter of the middle portion 50 of the game base 44.

Each of the plurality of attachers 58 is designed to deflect slightly between an undeflected position and a deflected position. The attachers 58 can be manually deflected or deformed to allow the game base 44 to be selectively attached to or detached from the base support 46. When the game base 44 is attached to the base support 46, the attachers 58 return to the undeflected position so as to retain the game base 44 attached to the base support 46. Further, while the game base 44 is attached to the base support 46, the game base 44 can rotate relative to the base support 46. For example, the game base 44 can include three attachers 58. Alternatively, the game base 44 can be designed with more than three attachers 58 or less than three attachers 58.

The channel 60 is positioned between the middle portion 50 and the outer portion 52 of the game base 44 and is sized and shaped to receive the cantilever section 34 of the figure base 22. The channel 60 is designed so that the cantilever section 34 of the figure base 22 can easily be positioned within the channel 60 without the need for deflecting or otherwise deforming any portion of the figure base 22 or the game base 44. Stated another way, the game base 44 is selectively attachable to and detachable from the figure base 22 without deforming either the figure base 22 or the game base 44. Further, the channel 60 and the cantilever section 34 of the figure base 22 cooperate to allow the figure base 22 to rotate relative to the game base 44. Still further, the plurality of spaced apart tabs 56, the channel 60 and the cantilever section 34 of the figure base 22 cooperate to allow the figure base 22 to rotate relative to the game base 44 in a step-like fashion.

In certain embodiments, the base support 46 can include an inner ring 82 having a plurality of notches 84, and an outer ring 86 having an outer surface 88 that includes one or more finger pads 90 and the supplemental game information 30.

The inner ring 82 of the base support 46 is substantially circular in shape, but it includes the plurality of notches 84 so as to effectively engage the plurality of attachers 58 of the game base 44. As the game base 44 is rotated relative to the base support 46, while the game base 44 is attached to the base support 46, each of the plurality of attachers 58 becomes positioned within one of the plurality of notches 84. As the attachers 58 move to successive notches 84 in the inner ring 82 of the base support 46, the game base 44 effectively rotates relative to the base support 46 in a step-like fashion. In one non-exclusive example, the base support 46 can include twenty notches 84. Alternatively, the base support 46 can be designed with more than twenty notches 84 or less than twenty notches 84.

The finger pads 90 are positioned adjacent to a base 92 of the outer surface 88 of the outer ring 86. The finger pads 90 are designed to provide the user a simplified means with which to cause the relative rotational movement between the game base 44 and the base support 46. As shown in FIGS. 1E and 1F, the base support 46 can include two finger pads 90 positioned on opposite sides of the base 92. Alternatively, the base support 46 can be designed with more than two finger pads 90 or less than two finger pads 90.

The supplemental game information 30 is mounted along an angled portion 94 of the outer surface 88 of the base support 46. As illustrated most clearly in FIG. 1E, the supplemental game information can include two series of numbers from 0 to 9. Alternatively, the supplemental game information 30 can include another series of numbers, a series of letters, a series of symbols, or some other information pertinent to the game 10 being played. The supplemental game information 30 is selectively revealed through the openings 28 that extend through the outer portion 52 of the game base 44 as the game base 44 is rotated relative to the base support 46. The step-like rotation of the game base 44 relative to the base support 46, as discussed above, is designed so that alternative supplemental game information 30 is clearly revealed through the openings 28 after each completed step in the step-like rotation.

The first game insert 48 is substantially circular in shape and is mounted on the middle portion 50 of the game base 44. The first game insert 48 includes the game information 24 that is selectively revealed through the slot 26 of the figure base 22 as the figure base 22 is rotated relative to the game base 44. As illustrated in the Figures, the game information 24 can include a series of numbers from 1 to 15. Alternatively, the game information 24 can include another series of numbers, a series of letters, a series of symbols, or some other information pertinent to the game 10 being played. The step-like rotation of the figure base 22 relative to the game base 44 is designed so that alternative game information 24 is clearly revealed through the slot 26 after each completed step in the step-like rotation.

In certain embodiments, referring back to FIG. 1B, the game assembly 18 can also include an alternative game insert 49 that includes alternative game information 24B that may be used as an alternative to the game information 24. When utilized in the playing of the game 10, the alternative game insert 49 would be mounted on the middle portion 50 of the game base 44, and the alternative game information 24B would be selectively revealed through the slot 26 of the figure base 22 as the figure base 22 is rotated relative to the game base 44. The alternative game information 24B can similarly include a series of numbers, a series of letters, a series of symbols, or some other information pertinent to the game 10 being played.

Figure 2:
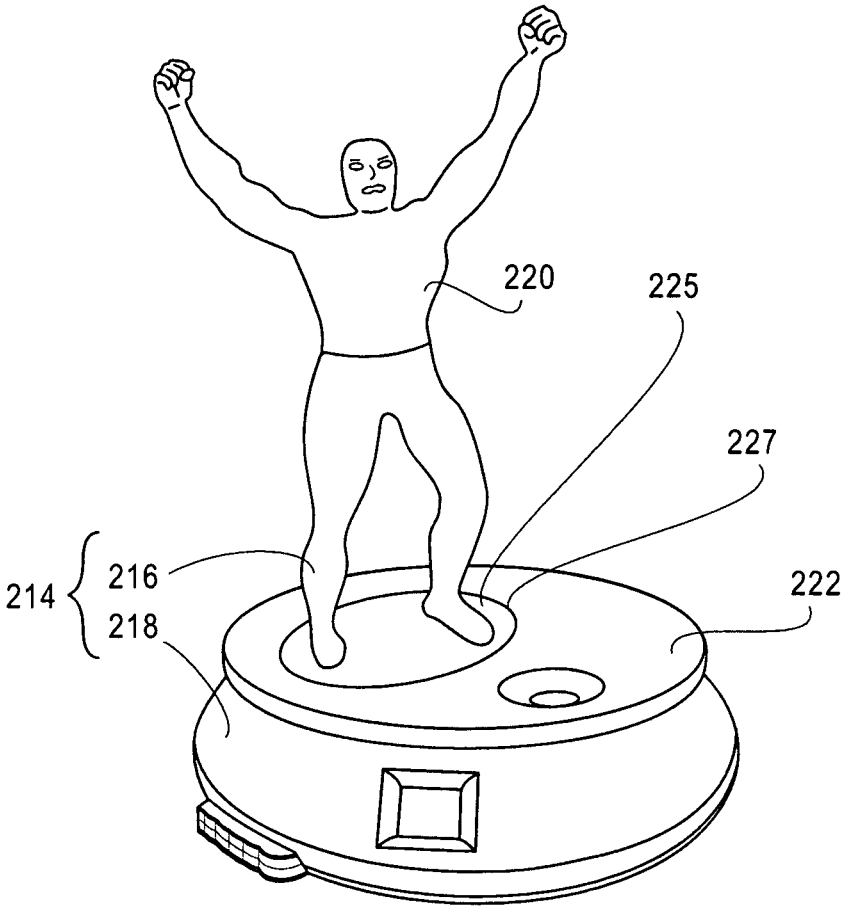
FIG. 2 is a perspective view of another embodiment of a portion of a combination having features of the present invention.

FIG. 2 is a perspective view of another embodiment of a portion of a combination 214 including a collectible miniature figurine 216 and a game assembly 218 that are similar to the corresponding components described above.

However, in this embodiment, the figure body 220 includes a body base 225 that is secured to and fits in a base recess 227 in the figure base 222. In this example, the body base 225 is somewhat circular disk shaped and provides an enlarged area fixedly securing the figure body 220 to the figure base 222.

Figure 3A:
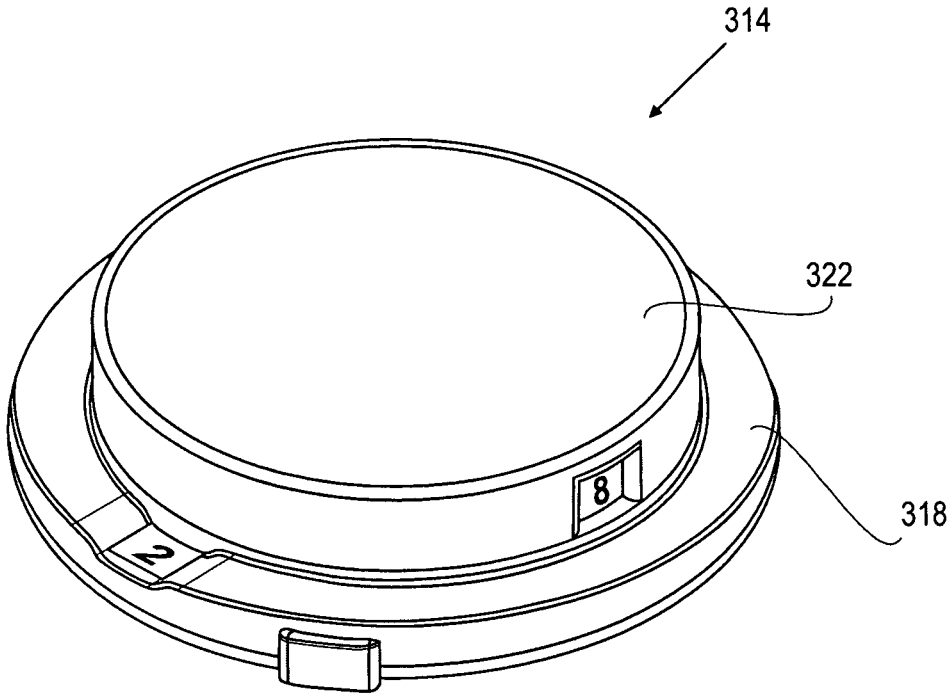
FIG. 3A is a top perspective view and FIG. 3B is a top view a portion of another combination having features of the present invention.
Figure 3B:
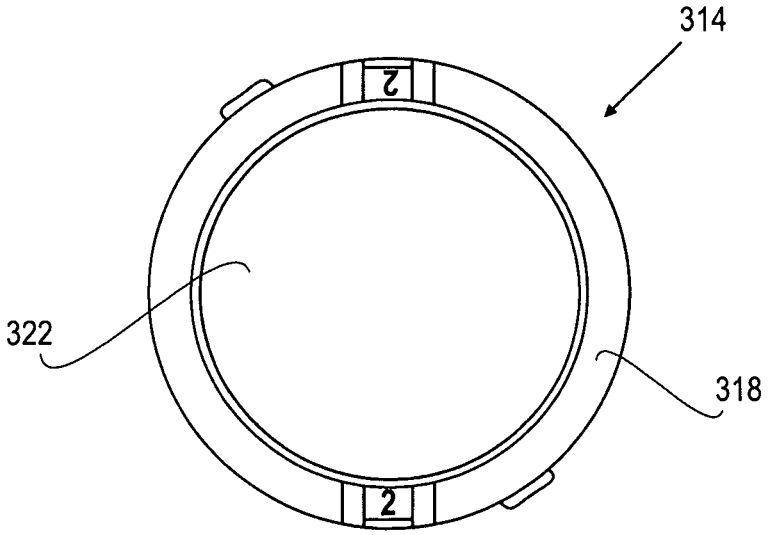

FIG. 3A is a top perspective view and FIG. 3B is a top view a portion of another combination 314 having features of the present invention. In this embodiment, the figure base 322 and the game assembly 318 are somewhat similar to the corresponding components described above. For example, the figure base 322 is again selectively attachable and detachable from the game assembly 318. However, in this embodiment, the figure base 322 encircles a portion of the game assembly 318. This feature allows the figure base 322 to rotate relative to the game assembly 318 and allows the figure base 322 to be selectively removed from the game assembly 318.

Figure 4A:
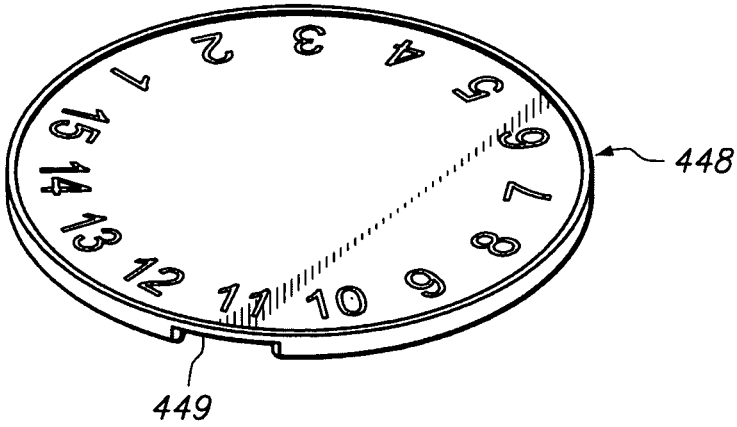
FIG. 4A is a top perspective view and FIG. 4B is a bottom perspective view of another embodiment of a first game insert having features of the present invention.
Figure 4B:
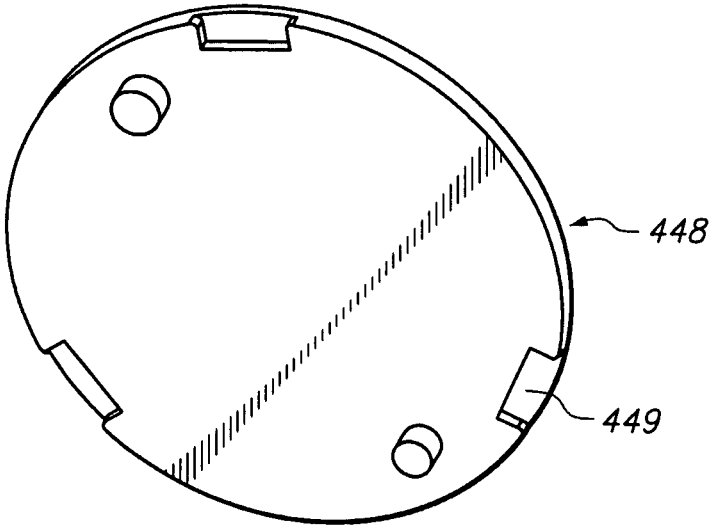
Figure 4C:
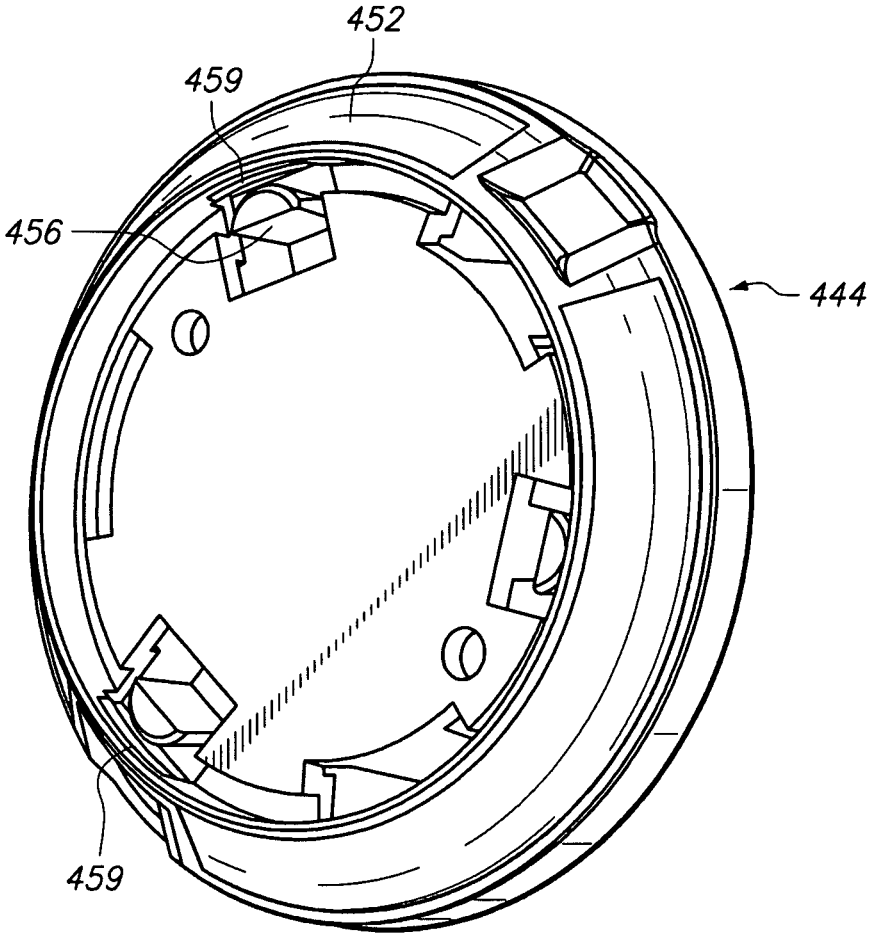
FIG. 4C is a top perspective view of another embodiment of a game base having features of the present invention.
Figure 4D:
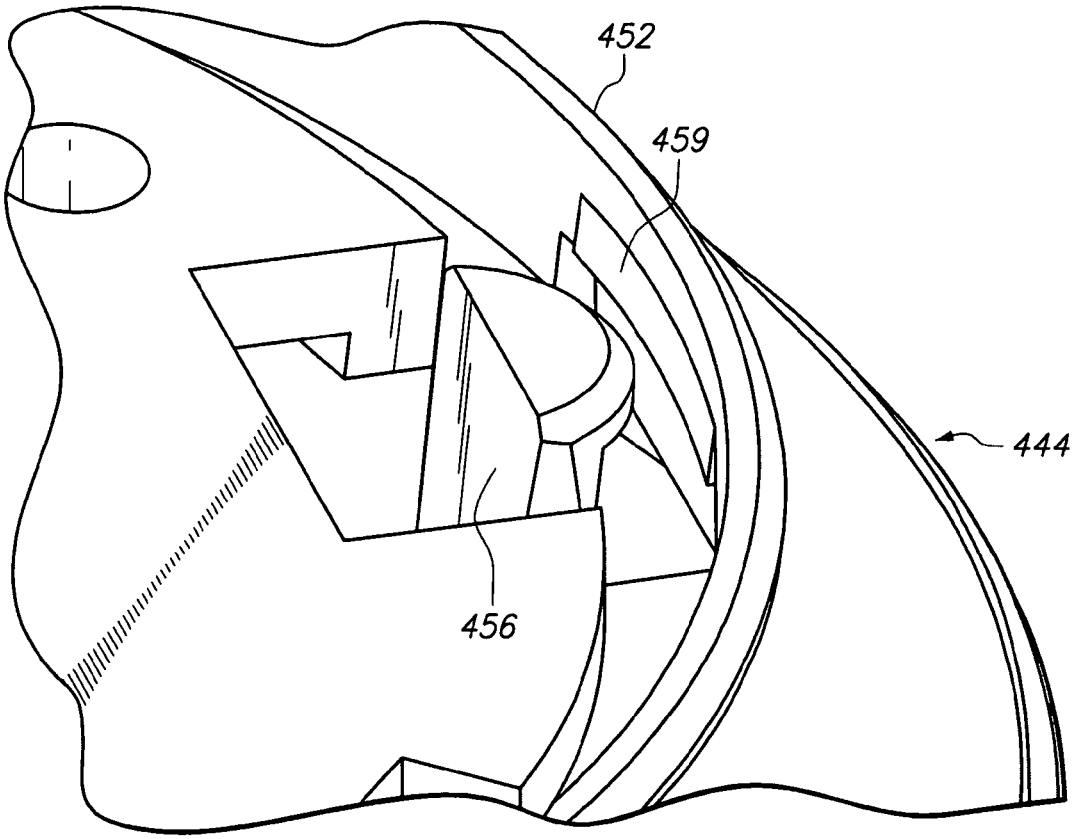
FIGS. 4D and 4E are alternative, enlarged views of a portion of the game base of FIG. 4C.
Figure 4E:
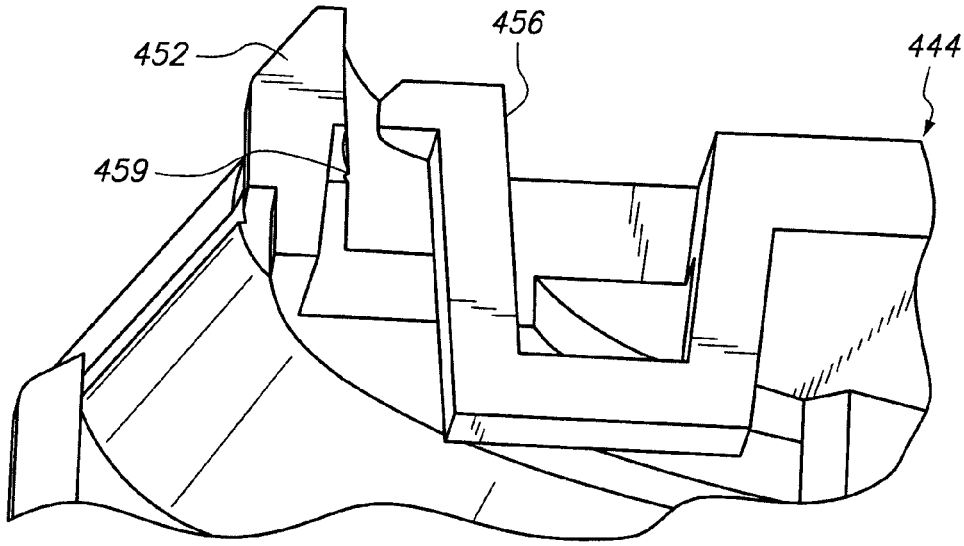

FIG. 4A is a top perspective view and FIG. 4B is a bottom perspective view of another embodiment of a first game insert 448. Further, FIG. 4C is a top perspective view of another embodiment of a game base 444 and FIGS. 4D and 4E are enlarged views of a portion of this game base 444. More specifically, FIG. 4E is a cut-away view.

Referring to FIGS. 4A and 4B, the first game insert 448 is somewhat similar to the corresponding component described above. However, in this embodiment, the bottom of the first game insert 448 includes three, generally rectangular shaped slots 449, spaced apart around the perimeter. This slots 449 are sized and shaped to allow for clearance of the tabs 456 (illustrated in FIGS. 4C and 4D).

Referring to FIGS. 4C, 4D, and 4E, the game base 444 is also somewhat similar to the corresponding component described above. However, in this embodiment, the game base 444 includes a separate revolve feature 459 that cooperates with the tabs 456 to provides additional security in gripping the cantilever section 34 (illustrated in FIGS. 1E and 1F) of the figure base 22 (illustrated in FIGS. 1E and 1F) while allowing the figure base 22 to be rotated relative to the game base 444 in a step-like fashion. Stated in another fashion, with this design, the revolve features 459 and the tabs 456 provide increased engagement with the figure base 22.

In this embodiment, the game base 444 includes three spaced apart revolve features 459 that are positioned on the outer portion 452 of the game base 444, with each revolve feature 459 being positioned adjacent to and spaced apart from one of the tabs 456. With this design, when fully assembled, the cantilever section 34 fits between the tabs 456 and the revolve features 459.

In one non-exclusive embodiment, the revolve feature 459 is a bump or bevel having a somewhat triangular shaped cross-section. With this design, the revolve feature 459 defines a bump that engages the cantilever section 34. Alternatively, the revolve feature 459 can have another shape.

Further, in certain embodiments, each of the tabs 456 deflects slightly when the miniature figurine is fully assembled.

While the particular embodiments of the combination as shown and disclosed herein are fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A combination comprising:

a collectible miniature figurine that includes a figure body and a figure base that retains and supports the figure body, the figure base including a substantially disk shaped mounting section and a ring shaped cantilever section that extends downward away from the mounting section; and a first game assembly that includes a first game base having a unitary structure and including a ring shaped channel, the figure base being selectively attachable to and detachable from the first game base by positioning the cantilever section of the figure base within the channel of the first game base without deforming either of the bases; wherein the figure base is selectively rotatable relative to the first game base when the figure base is attached to the first game base, and wherein the channel and the cantilever section cooperate to enable the rotational movement of the figure base relative to the first game base when the figure base is attached to the first game base.

2. The combination of claim 1 wherein the figure body is mounted on the mounting section.

3. The combination of claim 1 wherein the figure base is selectively rotatable relative to the first game base in a step-like fashion.

4. The combination of claim 1 wherein the first game assembly includes a first game insert that is secured to and moves with the first game base, the first game insert including first game information that is used in a game.

5. The combination of claim 4 wherein no game information is printed on or fixedly secured directly to the figure base.

6. The combination of claim 4 wherein the figure base includes a slot that selectively reveals a portion of the first game information.

7. The combination of claim 4 wherein the first game assembly includes a first base support, the first game base being attached to and supported by the first base support, wherein the first base support includes first supplemental game information that is used in the game, and wherein the first game base includes one or more openings that selectively reveal a portion of the first supplemental game information.

8. The combination of claim 1 wherein the first game assembly includes an alternative game insert that is secured to and moves with the first game base, the alternative game insert including alternative game information that is used in a game.

9. The combination of claim 1 wherein the first game assembly includes a first base support, the first game base being attached to and supported by the first base support.

10. The combination of claim 9 wherein the first game base is selectively rotatable relative to the first base support when the first game base is attached to the first base support.

11. The combination of claim 10 wherein the first game base is selectively rotatable relative to the first base support in a step-like fashion.

12. The combination of claim 10 wherein the first base support includes one or more finger pads to simplify the selective relative rotation of the first game base and the first base support.

13. The combination of claim 9 wherein the first base support includes first supplemental game information that is used in a game and the first game base includes one or more openings that selectively reveal a portion of the first supplemental game information.

14. The combination of claim 1 further comprising a second game assembly that includes a second game base that is selectively attachable to and detachable from the figure base without deforming either the second game base or the figure base; wherein the figure base is selectively rotatable relative to the second game base when the figure base is attached to the second game base.

15. The combination of claim 14 wherein the first game assembly includes a first game insert that is secured to and moves with the first game base, the first game insert including first game information that is used in a game, and wherein the second game assembly includes a second game insert that is secured to and moves with the second game base, the second game insert including second game information that is used in a game, the second game information being different than the first game information.

16. The combination of claim 1 wherein the figure body is fixedly secured to the figure base.

17. The combination of claim 1 wherein the figure body is removably secured to the figure base.

18. A method for making a combination, the method comprising the steps of:

providing a collectible miniature figurine that includes a figure body and a figure base that retains and supports the figure body, the figure base including a substantially disk shaped mounting section and a ring shaped cantilever section that extends downward away from the mounting section;

providing a first game assembly that includes a first game base having a unitary structure and including a ring shaped channel;

selectively attaching the figure base to the first game base by positioning the cantilever section of the figure base within the channel of the first game base without deforming either of the bases; and selectively rotating the figure base relative to the first game base when the figure base is attached to the first game base, wherein the channel and the cantilever section cooperate to enable the rotational movement of the figure base relative to the first game base when the figure base is attached to the first game base.

19. The method of claim 18 wherein the first game assembly includes a first game insert that is secured to and moves with the first game base, the first game insert including first game information that is used in a game.

20. The method of claim 19 further comprising the step of selectively revealing a portion of the first game information through a slot in the figure base.

21. The method of claim 19 wherein the first game assembly includes a first base support, the first game base being attached to and supported by the first base support, wherein the first base support includes first supplemental game information that is used in the game, and wherein the first game base includes one or more openings that selectively reveal a portion of the first supplemental game information.

22. The method of claim 18 further comprising the steps of providing a second game assembly that includes a second game base; selectively attaching the figure base to the second game base without deforming either the figure base or the second game base; and selectively rotating the figure base relative to the second game base when the figure base is attached to the second game base.

23. The method of claim 22 further comprising the steps of providing a second game insert that is secured to and moves with the second game base, the second game insert including second game information that is used in a game; and selectively revealing a portion of the second game information through a slot in the figure base.

24. A combination comprising:

a collectible miniature figurine that includes a figure body and a figure base that retains and supports the figure body, the figure base including (i) a substantially disk shaped mounting section, (ii) a ring shaped cantilever section that extends downward away from the mounting section, and (iii) a slot; and a first game assembly that includes (i) a first base support; (ii) a first game base including a ring shaped channel, the first game base being attached to and supported by the first base support, the cantilever section of the figure base being sized and shaped to fit within the channel of the first game base without deforming either of the bases; and (iii) a first game insert that is secured to and moves with the first game base, the first game insert including first game information that is used in a game, the slot selectively revealing a portion of the first game information; wherein the first base support includes first supplemental game information that is used in the game, and wherein the first game base includes one or more openings that selectively reveal a portion of the first supplemental game information, the first supplemental game information not being revealed through the slot.

25. The combination of claim 24 wherein the figure base is selectively attachable to and detachable from the first game base.

26. The combination of claim 25 wherein the figure base is selectively rotatable relative to the first game base when the figure base is attached to the first game base.

27. The combination of claim 26 wherein the figure base is selectively rotatable relative to the first game base in a step-like fashion.

28. The combination of claim 26 wherein the channel and the cantilever section cooperate to enable the rotational movement of the figure base relative to the first game base when the figure base is attached to the first game base.

29. The combination of claim 24 further comprising a second game assembly that includes (i) a second base support; (ii) a second game base including a ring shaped channel, the second game base being attached to and supported by the second base support, the cantilever section of the figure base being sized and shaped to fit within the channel of the second game base without deforming either of the bases; and (iii) a second game insert that is secured to and moves with the second game base, the second game insert including second game information that is used in the game, the slot selectively revealing a portion of the second game information.

30. The combination of claim 29 wherein the figure base is selectively attachable to and detachable from the second game base, and wherein the figure base is selectively rotatable relative to the second game base when the figure base is attached to the second game base.

* * * * *